US007396095B2

(12) United States Patent
Nakagawa et al.

(10) Patent No.: US 7,396,095 B2
(45) Date of Patent: Jul. 8, 2008

(54) INK JET PRINTING APPARATUS AND PRELIMINARY INK EJECTION METHOD

(75) Inventors: Yoshinori Nakagawa, Kanagawa (JP); Minoru Teshigawara, Kanagawa (JP); Satoshi Seki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 414 days.

(21) Appl. No.: 11/153,343

(22) Filed: Jun. 16, 2005

(65) Prior Publication Data

US 2005/0275681 A1 Dec. 15, 2005

Related U.S. Application Data

(62) Division of application No. 10/658,276, filed on Sep. 10, 2003, now Pat. No. 6,984,009.

(30) Foreign Application Priority Data

Sep. 12, 2002 (JP) ..... 2002-267348

(51) Int. Cl.
*B41J 29/38* (2006.01)

(52) U.S. Cl. ..... 347/9; 347/29; 347/30; 347/35

(58) Field of Classification Search ..... 347/9–12, 347/15, 29, 30, 35
See application file for complete search history.

(56) References Cited

U.S. PATENT DOCUMENTS

| | | | | |
|---|---|---|---|---|
| 5,412,410 | A * | 5/1995 | Rezanka | 347/15 |
| 6,079,809 | A * | 6/2000 | Yaegashi et al. | 347/35 |
| 2001/0005210 | A1 * | 6/2001 | Suzuki | 347/35 |
| 2004/0041862 | A1 | 3/2004 | Nakagawa et al. | |
| 2004/0041873 | A1 | 3/2004 | Iwasaki et al. | |
| 2004/0041874 | A1 | 3/2004 | Seki et al. | |

* cited by examiner

*Primary Examiner*—Manish S. Shah
*Assistant Examiner*—Mark J Stevenosky, Jr.
(74) *Attorney, Agent, or Firm*—Fitzpatrick, Cella, Harper & Scinto

(57) ABSTRACT

In a print head having arrays of large nozzles and small nozzles with different ink ejection volumes that are connected to a common ink chamber, the preliminary ejection operation is performed 29,000 times first on only the large nozzles at an ejection frequency of 10 kHz to discharge viscous or mixed color ink from ink chambers. After the preliminary ejection operation of the large nozzles is finished, only the small nozzles are made to perform the preliminary ejection operation 2,000 times at an ejection frequency of 10 kHz. Reducing the number of preliminary ejections from the small nozzles in this manner can minimize the generation of stray mist. Further, by performing the preliminary ejection operation on the large nozzles first, it is possible to discharge enough viscous ink from the ink chamber.

11 Claims, 6 Drawing Sheets

INK JET PRINTING APPARATUS AND PRELIMINARY INK EJECTION METHOD

This application is a division of application Ser. No. 10/658,276 filed Sep. 10, 2003 now U.S. Pat. No. 6,984,009.

This application claims priority from Japanese Patent Application No. 2002-267348 filed Sep. 12, 2002, which is incorporated hereinto by reference.

BACKGROUND OF THE INVENTION

1. Field of the Invention

The present invention relates to an ink jet printing apparatus and a preliminary ink ejection method executed following a suction-based ink ejection performance recovery operation.

2. Description of the Related Art

Printing apparatus used as a means for printing images in printers, copying machines and facsimiles or printing apparatus used as output devices of composite electronic machines and workstations including computers and word processors are designed to print images on print media, such as paper and plastic thin plates, according to image information (all output information including character information). These printing apparatus can be classified into an ink jet system, a wire dot system, a thermal system and a laser beam system in terms of a printing method employed. The printing apparatus of ink jet system (hereinafter referred to as ink jet printing apparatus) forms an image by ejecting ink from a printing means including a print head onto a print medium and has an advantage of being able to enhance a resolution more easily than other printing systems. Other advantages include a fast printing speed, low noise and low cost. As color outputs such as color images have an increasing importance in recent years, a growing number of color ink jet printing apparatus capable of producing a high image quality comparable to that of a silver salt picture are being developed.

In such ink jet printing apparatus, to improve a printing speed, a print head with an array of integrated printing elements generally has a plurality of ink ejection openings and liquid paths integrally formed therein. To deal with color printing, a printing apparatus with a plurality of print heads, one for each of different ink colors, has come into wide use.

FIG. 1 shows main components of the printing apparatus for printing on paper using a print head. In the figure, designated 101 are ink jet cartridges each of which includes an ink tank containing one of four color inks—black, cyan, magenta and yellow—and a print head 102 having a nozzle array assigned to that ink color.

FIG. 2 is a schematic diagram of the print head of FIG. 1 as seen from a direction z. A plurality of ejection openings (also referred to as "nozzles") are arranged in columns by ink colors. Designated 201 are nozzles that are formed in the print head 102 at a density of D nozzles per inch (D dpi) and can eject 10 pl of yellow ink. Nozzles capable of ejecting 10 pl of ink are called "large nozzles" and dots formed by ink droplets ejected from the large nozzles are called "large dots." Denoted 202 are nozzles smaller in diameter than the large nozzles and capable of ejecting 5 pl of yellow ink. The nozzles that eject 5 pl of ink are called "small nozzles" and dots formed by ink droplets ejected from the small nozzles are called "small dots." Likewise, 203, 205 and 207 represent large nozzles for magenta, cyan and black inks, respectively, and 204, 206 and 208 represent small nozzles for magenta, cyan and black inks, respectively.

The large nozzles and small nozzles for each color ink are formed at front ends of liquid paths 210 extending from one and the same liquid chamber 209.

Returning back to FIG. 1, designated 103 is a paper feed roller 103 which rotates in a direction of the shown arrow together with an auxiliary roller 104 to hold a print medium P between them and feed it in a y direction (sub-scan direction). Denoted 105 are a pair of paper supply rollers to supply a print medium. The paired paper supply rollers 105 rotate holding the print medium P in between, as with the rollers 103 and 104, but their rotating speed is set smaller than that of the paper feed roller 103 to create tension in the print medium. Denoted 106 is a carriage which supports the four ink jet cartridges 101 and scans them as they eject ink. The carriage 106 is situated at a home position h indicated by a dashed line in the figure when no printing operation is performed or when the print head 102 is subjected to an ejection performance recovery operation by a suction device 107.

The recovery operation includes a suction-based recovery operation. This operation sucks out and discharges viscous ink, bubbles in the print head liquid chamber and mixed inks by the suction device 107 installed in the ink jet printing apparatus. The suction-based recovery operation normally involves capping a face of the print head, i.e., nozzle-formed surface, with a cap and then creating a negative pressure in the cap by a pump means such as a tube pump or piston pump. The negative pressure thus generated causes the ink in the print head liquid chamber to be sucked and discharged out of the print head through the print head nozzles. Immediately after the suction operation, however, the ink sucked out into the cap remains on the print head face and this residual ink may flow back into the print head. This reverse flow may result in the viscous ink remaining in the liquid chamber 209 of the print head. When the print heads of multiple colors are capped with a single cap for recovery operation, this reverse flow causes color ink mixing.

Therefore, after the suction-based recovery operation is executed, viscous ink and mixed inks are ejected out into the cap until these inks are completely discharged from the head. This recovery operation is called a preliminary ejection.

The amount of power supplied from a power source to drive the print head is set assuming a normal printing condition. So, if during the preliminary ejection operation all nozzles are activated simultaneously for ejection, the power consumption exceeds the amount of power supply. Thus, all the nozzles cannot be driven at the same time and normally the nozzles of the print head are divided into some groups that undergo the preliminary ejection operation at different times.

For example, after the suction-based recovery operation is done, the large nozzles each perform 20,000 preliminary ejections at a frequency of 10 kHz, followed by each small nozzle performing 20,000 preliminary ejections at a frequency of 10 kHz. This preliminary ejection cycle can discharge viscous ink and mixed inks. The preliminary ejection cycle that follows the suction-based recovery operation takes 4.0 seconds.

During the preliminary ejections, as during the ejections for normal printing, the ejected ink does not fly as a single droplet but is split into a plurality of ink droplets. A biggest ink droplet of these split droplets is called a main droplet, smaller ink droplets following the main droplet are called satellites, and finer droplets flying at slower speeds are called stray mist.

FIGS. 3A to 3C schematically illustrate how the main droplet, satellites and stray mist are formed at the time of ink ejection.

Denoted 301 is ink, 302 ink immediately after being ejected, 303 a meniscus, 304 a main droplet, 305 satellites and 306 stray mist.

An ink ejection initiates as shown in FIG. 3A. Immediately after the ejection, the ink 302 is shot continuously from a nozzle. Then, as shown in FIG. 3B, the meniscus 303, formed by the contraction of a bubble or the deformation of a piezoelectric element, retracts, causing the ink 301 to move into the interior of the print head 102. As the ink 301 moves inwardly, the projected ink 302 separates from the ink in the print head, with the result that a speed distribution is generated in the flying ink 302. As shown in FIG. 3C, the ink with a speed distribution is split into a droplet with the largest volume and the highest speed (main droplet 304), ink droplets with smaller volumes and slower speeds (satellites 305), and ink droplets with even smaller volumes and slower speeds (stray mist 306) that do not reach the interior of the cap.

The preliminary ejection is carried out in the cap of the suction device 107 so that most of the ejected ink is accommodated in the cap. However, the stray mist 306 with small volume and slow speed does not reach the cap but floats around the print head, adhering to the print head face. If, for example, the stray mist adheres to transport rollers or others, not only does it stain the transport rollers, but this stain is also transferred onto the print medium, degrading the image quality.

The volume of the stray mist 306 increases as the number of preliminary ejections and the ejection frequency increase and the volume of ink ejected from each nozzle decreases. When the number of preliminary ejections increases, the volume of stray mist 306 increases proportionally. In a high-frequency preliminary ejection operation, an air flow is generated among nearby nozzles by the ink droplets ejected at high frequencies and this air flow in turn swirls up mist which easily adheres to the print head face. The satellites 305 produced from nozzles of a large ejection volume have a sufficient mass and speed to land on the cap, whereas satellites 305 produced from nozzles of a small ejection volume have an insufficient mass and speed to reach the cap. The latter satellites therefore are likely to become stray mist 306. Such an increase in the stray mist 306 results in an increase in stain.

Therefore, the preliminary ejection operation performed after the suction-based recovery operation may take long depending on the number of preliminary ejections and the ejection frequency.

Further, depending on the ink volume ejected by the preliminary ejections, the number of preliminary ejections performed and the ejection frequency, most of the stain due to the stray mist adheres to the interior of the ink jet printing apparatus, from which the stain is further transferred onto a print medium, making it impossible to produce a desired image.

As described above, the conventional ink jet printing apparatus is required to execute preliminary ejections after the suction-based recovery operation, and the time taken by the preliminary ejection operation varies depending on the number of preliminary ejections and the ejection frequency. Thus, performing sufficient preliminary ejections on each nozzle will take some time. The combined execution of the suction-based recovery operation and the preliminary ejection operation therefore will take long, giving the user an impression of a long wait after a power-up of the apparatus before the printing actually starts.

Further, depending on the ink volume of preliminary ejections, the number of preliminary ejections performed and the ejection frequency, a large amount of stray mist may be produced and adhere to the print head face. This in turn may affect the direction of ink ejection during the printing operation or cause mixing of color inks. The stray mist may also adhere to transport rollers or other components in the printing apparatus, from which the ink mist may be transferred as stain onto the print medium, degrading a printed image quality.

SUMMARY OF THE INVENTION

The present invention has been accomplished to overcome the above-described problems. It is an object of the present invention to provide an ink jet printing apparatus and a preliminary ink ejection method which prevent a mixing of color inks near nozzles of a print head after a suction-based recovery operation is finished and which also prevent a print medium from being stained by stray mist adhering to an interior of the printing apparatus.

It is another object of the present invention to shorten the time it takes for the preliminary ejection operation following the suction-based recovery operation to be completed.

According to one aspect the present invention provides an ink jet printing apparatus for forming an image by ejecting ink from a print head onto a print medium, wherein the print head has arrayed in nozzle columns at least two kinds of nozzles that eject different volumes of ink supplied from a common ink chamber, the ink jet printing apparatus comprising: a preliminary ejection means for performing ink ejections, not involved in the formation of an image, from the nozzles of the print head; and a suction means for sucking out ink from the print head; wherein the preliminary ejection means performs the preliminary ejection operation on the same kind of nozzles at one time after the print head is sucked by the suction means, and sets the number of preliminary ejections from the nozzles with a large ink ejection volume larger than the number of preliminary ejections from the nozzles with a small ink ejection volume.

According to another aspect the present invention provides an ink jet printing apparatus for forming an image by ejecting ink from a print head onto a print medium, wherein the print head has arrayed in nozzle columns at least two kinds of nozzles that eject different volumes of ink supplied from a common ink chamber, the ink jet printing apparatus comprising: a preliminary ejection means for performing ink ejections, not involved in the formation of an image, from the nozzles of the print head; and a suction means for sucking out ink from the print head; wherein the preliminary ejection means performs the preliminary ejection operation on the same kind of nozzles at one time after the print head is sucked by the suction means, and sets an ejection frequency of the nozzles with a small ink ejection volume lower than an ejection frequency of the nozzles with a large ink ejection volume.

According to a further aspect the present invention provides a preliminary ink ejection method using an ink jet printing apparatus, wherein the ink jet printing apparatus forms an image by ejecting ink from a print head onto a print medium, wherein the print head has arrayed in nozzle columns at least two kinds of nozzles that eject different volumes of ink supplied from a common ink chamber, the preliminary ink ejection method comprising: a preliminary ejection step of performing ink ejections, not involved in the formation of an image, from the nozzles of the print head; and a suction step of sucking out ink from the print head; wherein the preliminary ejection step performs the preliminary ejection operation on the same kind of nozzles at one time after the print head is sucked by the suction step, and sets the number of preliminary ejections from the nozzles with a large ink ejection volume larger than the number of preliminary ejections from the nozzles with a small ink ejection volume.

According to a further aspect the present invention provides a preliminary ink ejection method using an ink jet printing apparatus, wherein the ink jet printing apparatus forms an image by ejecting ink from a print head onto a print medium, wherein the print head has arrayed in nozzle columns at least two kinds of nozzles that eject different volumes of ink supplied from a common ink chamber, the preliminary ink ejection method comprising: a preliminary ejection step of performing ink ejections, not involved in the formation of an image, from the nozzles of the print head; and a suction step of sucking out ink from the print head; wherein the preliminary ejection step performs the preliminary ejection operation on the same kind of nozzles at one time after the print head is sucked by the suction step, and sets an ejection frequency of the nozzles with a small ink ejection volume lower than an ejection frequency of the nozzles with a large ink ejection volume.

With the above construction, since the nozzles with a large ink ejection volume first undergo the preliminary ejection operation in advance of the nozzles with a small ink ejection volume and execute a larger number of ejections than do the nozzles with a small ink ejection volume, viscous or mixed color ink can be discharged satisfactorily from the ink chamber and ink paths and a total number of preliminary ejections can be reduced. This in turn reduces the time taken by the preliminary ejection operation.

Further, by reducing the ejection frequency at which the nozzles with a small ink ejection volume perform the preliminary ejection operation or by reducing the number of preliminary ejections from the nozzles with a small ink ejection volume, the generation of stray mist can be minimized.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, one embodiment of the present invention will be described in detail by referring to the accompanying drawings.

Figure 1:
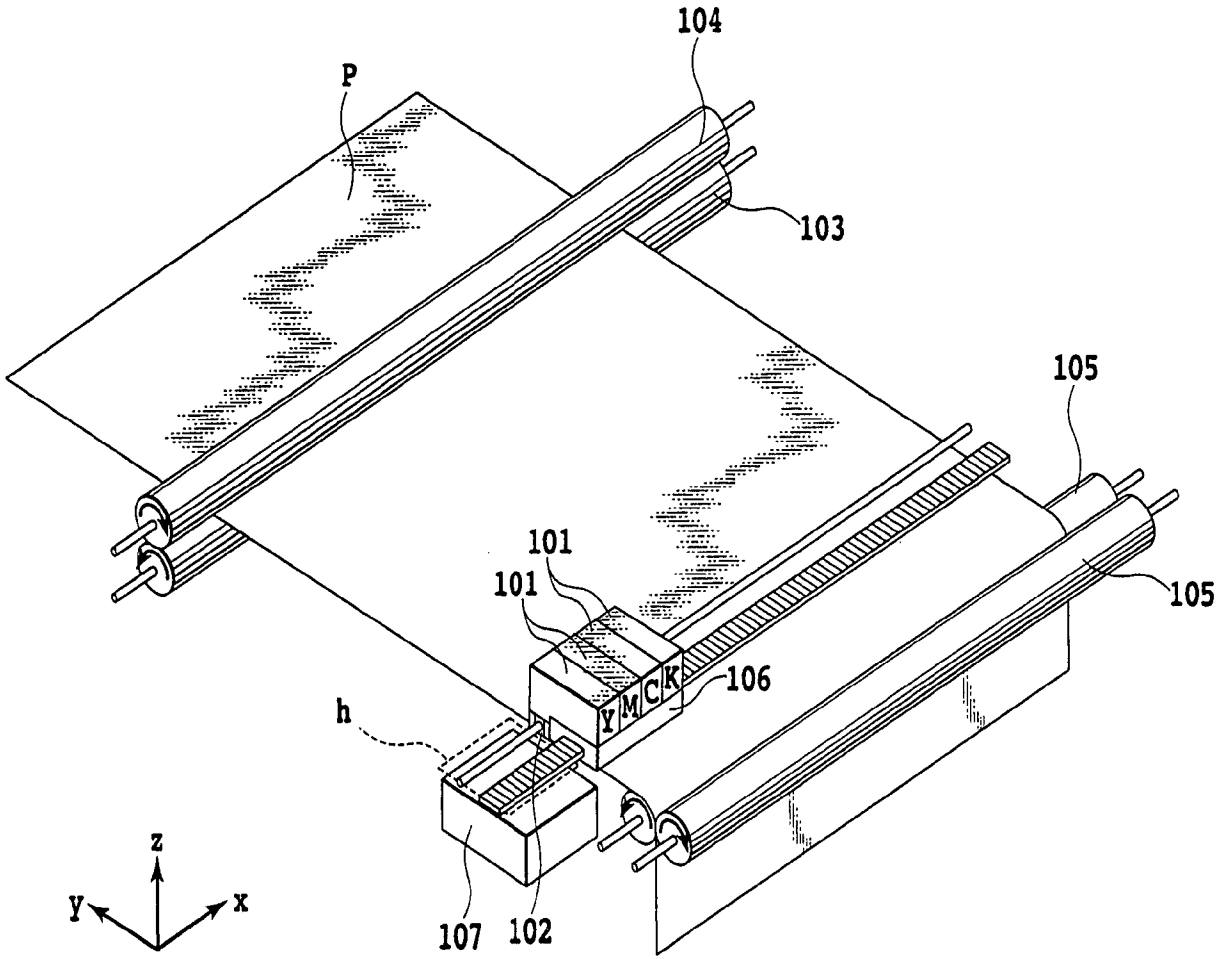
FIG. 1 is a perspective view showing main components of an ink jet printing apparatus as one embodiment of the invention.

FIG. 1 is a perspective view showing an ink jet printing apparatus of this embodiment. A mechanical construction of this embodiment is similar to that described above.

A print head 102 has an electrothermal transducer in each nozzle. The electrothermal transducer produces a bubble in ink by its heat energy and a pressure of the growing bubble expels a predetermined volume of ink as a droplet from the nozzle. While the print head of this embodiment ejects ink by a bubble-through method as described above, the present invention is not limited to this method but may of course employ other methods, such as a piezoelectric method.

Figure 4:
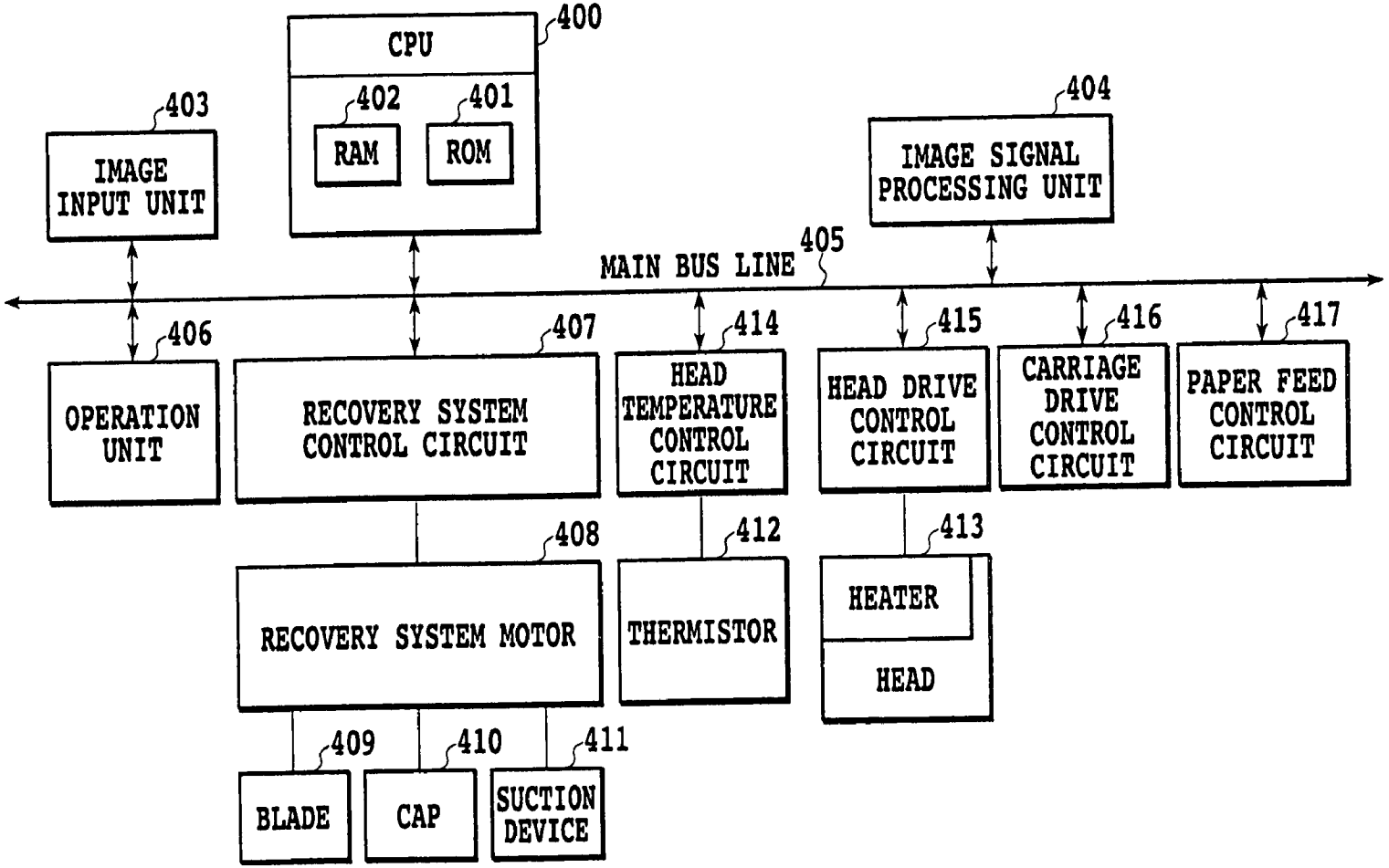
FIG. 4 is a block diagram showing an electrical configuration of the embodiment of the ink jet printing apparatus.

FIG. 4 is a block diagram showing an electrical configuration of the ink jet printing apparatus of this embodiment.

A CPU 400 controls various components in the apparatus and processes data through a main bus line 405. That is, the CPU 400 performs data processing, head driving and carriage driving through the following components according to a program stored in a ROM 401. A RAM 402 is used by the CPU 400 as a work area for data processing. In addition to these memories hard disk drives are provided. An image input unit 403 has an interface with a host device and temporarily holds an image received from the host device. An image signal processing unit 404 executes data processing such as color conversion and binarization.

An operation unit 406 has keys that allow for operator control and input. A recovery system control circuit 407 controls a recovery operation such as preliminary ejections according to a recovery operation program stored in the ROM 401. That is, a recovery system motor 408 drives a print head 413, a cleaning blade 409 spaced from and opposing the print head, a cap 410 and a suction device 411. A head drive control circuit 415 controls an operation of the ink ejection electrothermal transducers in the print head 413 and thereby causes the print head 413 to perform preliminary ejections and ink ejections for printing. Further, a carriage drive control circuit 416 and a paper feed control circuit 417 control a movement of the carriage and a paper feed according to a program.

A printed circuit board of the print head 413, in which the ink ejection electrothermal transducers are installed, is provided with a heater to heat the ink in the print head to a desired set temperature. A thermistor 412 is also provided in the board to measure a substantial temperature of the ink in the print head. The thermistor 412 may be installed outside the board or around the print head, rather than inside it.

Some preferred embodiments of this invention with the above construction will be described as follows.

Embodiment 1

Figure 2:
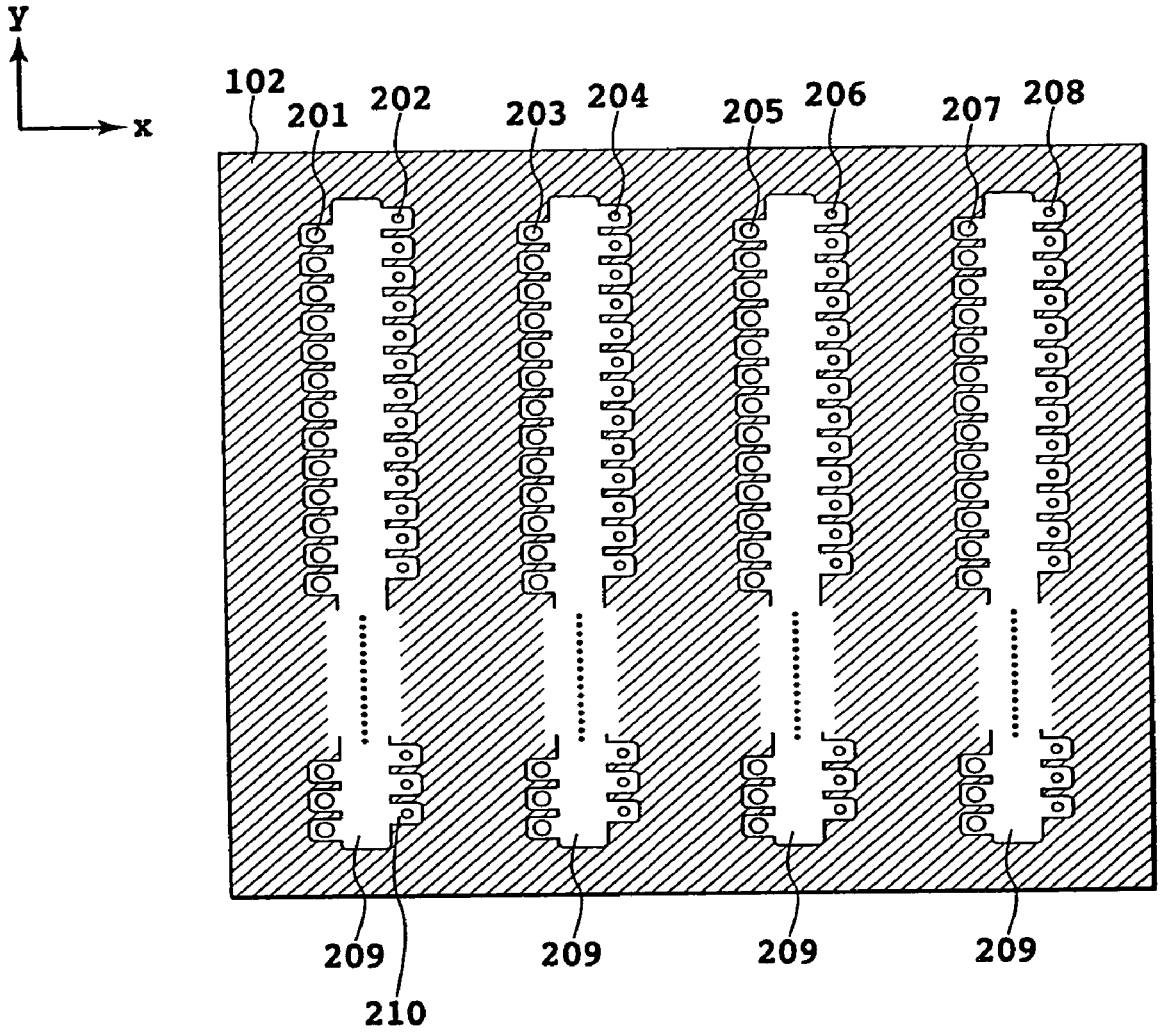
FIG. 2 is a schematic diagram showing a nozzle-formed face of a print head.
Figure 3A:
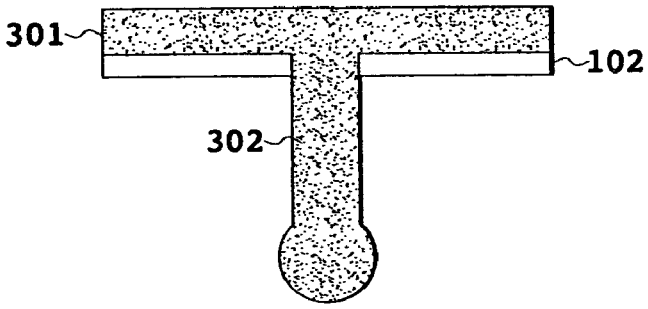
FIG. 3A is a schematic diagram showing an ink droplet immediately after being ejected.
Figure 3B:
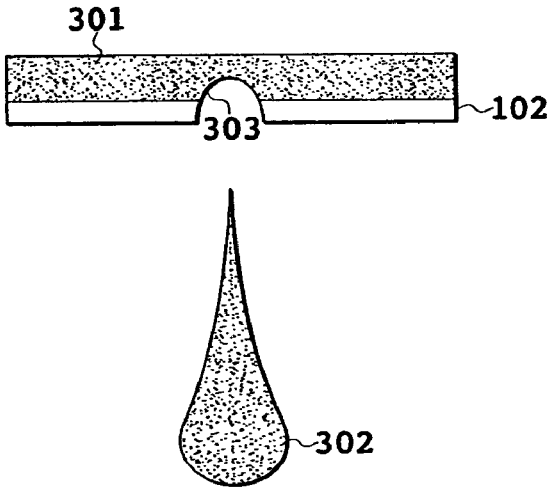
FIG. 3B is a schematic diagram showing an ink droplet just separated from a nozzle as a meniscus retracts.
Figure 3C:
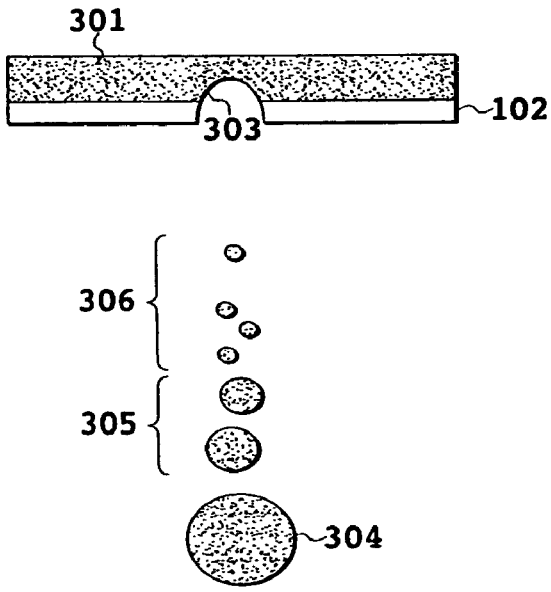
FIG. 3C is a schematic diagram showing a main droplet, satellites and stray mist.

FIG. 2 is a schematic diagram showing a nozzle-formed face of the print head used in this embodiment.

Each of the nozzle columns has 128 ejection openings (128 nozzles) at a nozzle pitch of about 42.4 μm and a print head length of 5.42 mm. The large nozzle column and the small nozzle column for each color are spaced 0.3 mm from each other, and adjoining liquid chambers of different colors are equally spaced by 1 mm. A large nozzle column 207 for black is situated upstream in a direction x (on the print area side) and a large nozzle column 201 for yellow is situated downstream in the direction x (on the suction device side).

The cap in the suction device has a width of 5 mm in the x direction, which allows all the nozzle columns of yellow, magenta, cyan and black to be subjected simultaneously to the suction-based recovery operation and also to the preliminary ejection operations.

As described earlier, the conventional preliminary ejection practice shoots 20,000 large dots from every large nozzle of each color at an ejection frequency of 10 kHz and 20,000 small dots from every small nozzle of each color at an ejection frequency of 10 kHz. Since the adjoining large nozzle column and small nozzle column are supplied ink from the same liquid chamber, this preliminary ejection operation discharges a total of (10 pl+5 pl)×20,000 ejections×128 nozzles=38.4 μl from one liquid chamber. Discharging this large volume of ink can remove viscous or mixed color ink that is produced during the suction-based recovery operation.

Figure 5:
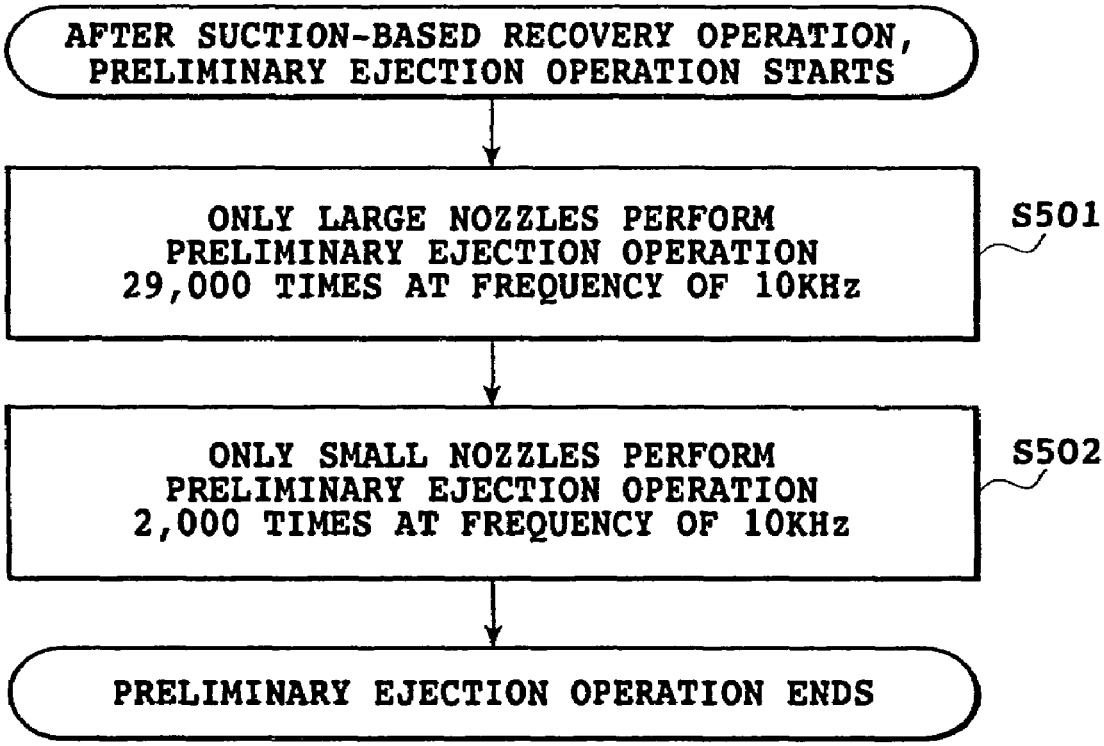
FIG. 5 is a flow chart showing a sequence of steps performed by a preliminary ejection operation.

FIG. 5 is a flow chart showing a sequence of steps performed by the preliminary ejection operation. The control according to this chart is executed by the CPU 400, a control means shown in FIG. 4.

First, the large nozzles each make 29,000 ejections at an ejection frequency of 10 kHz (step 501) to discharge viscous or mixed color ink from the liquid chamber 209 and liquid paths of the large-nozzles. Then, the small nozzles each make 2,000 ejections at an ejection frequency of 10 kHz to discharge viscous or mixed color ink from the liquid paths of the small-nozzles (step 502). The volume of ink discharged by this preliminary ejection operation is 38.4 μl, the same volume as that of the conventional practice, which is enough to remove the viscous or mixed color ink.

Additionally, the number of preliminary ejections from the small-nozzle is defined as a minimum number of preliminary ejections for discharging viscous or mixed color ink. More specifically, even if large amounts of inks are ejected from the large-nozzles, viscous or mixed color ink cannot be discharged from the liquid paths of the small-nozzles sufficiently, due to a specific structure of the liquid chamber, the liquid path and the like in the head. Therefore, a given number of preliminary ejections from the small-nozzles are required to discharge viscous or mixed color ink from the liquid paths sufficiently. In this embodiment, if the number of preliminary ejections from the small-nozzles is far less than 2,000 ejections, the viscous or mixed color ink remains in the small-nozzle liquid paths.

However, the total number of preliminary ejections is only 31,000, of which 29,000 ejections are from every large nozzle and 2,000 from every small nozzle. Compared with the conventional 40,000 preliminary ejections, of the total of which 20,000 ejections are from each large nozzle and 20,000 from each small nozzle, this embodiment performs as much as 9,000 less ejections. The time taken by the preliminary ejection operation of this embodiment is 3.1 seconds, 0.9 second shorter than that of the conventional practice.

Further, since the number of preliminary ejections from small nozzles, which are more likely to produce stray mist than the large nozzles, is reduced to one-tenth that of the conventional practice, the generation of stray mist can be minimized significantly compared with the conventional practice. This in turn can reduce image impairments due to stray mist, including deviations of ejection direction and color ink mixing, and also a staining of the ink jet printing apparatus caused by stray mist adhering to its interior. Further, since the viscous or mixed color ink is already discharged sufficiently from the liquid chamber by the preliminary ejection operation of the large nozzles, the reduced number of preliminary ejections from small nozzles, one-tenth that of the conventional practice, is good enough to remove viscous or mixed color ink from only the liquid paths of the small-nozzles.

As described above, in an ink jet printing apparatus with an ink jet print head and a suction device, in which the ink jet print head has at least two kinds of nozzles connected to one and the same liquid chamber and adapted to eject different volumes of liquid and in which a preliminary ejection operation is performed following a suction-based recovery operation, it is possible to eliminate a color ink mixing that would otherwise occur after the execution of the suction-based recovery operation and to print a desired image in a short time by reducing the number of preliminary ejections from the small nozzles compared with that from the large nozzles.

Embodiment 2

A print head used in this embodiment is similar to that of FIG. 2 used in Embodiment 1. The number of preliminary ejections following the suction-based recovery operation is set to 29,000 ejections from each large nozzle and 2,000 ejections from each small nozzle, as in Embodiment 1.

While in Embodiment 1 the preliminary ejections from the small nozzles are performed at a frequency of 10 kHz, this embodiment performs preliminary ejections from the small nozzles at 5 kHz.

With the small-nozzle preliminary ejections performed at 5 kHz, the overall preliminary ejection operation takes 3.3 seconds to complete, which is slightly longer than 3.1 seconds in Embodiment 1 but 0.7 second shorter than the conventional preliminary ejection time of 4.0 seconds.

Further, since the volume of stray mist increases as the ejection frequency increases, performing the small-nozzle preliminary ejections at a low frequency of 5 kHz rather than 10 kHz can reduce the amount of stray mist produced. That is, the stray mist can be reduced in volume as compared to that in Embodiment 1, which in turn reduces contamination of the interior of the ink jet printing apparatus caused by the stray mist.

As described above, in an ink jet printing apparatus with an ink jet print head and a suction device, in which the ink jet print head has at least two kinds of nozzles connected to one and the same liquid chamber and adapted to eject different volumes of liquid and in which a preliminary ejection operation is performed following a suction-based recovery operation, it is possible to eliminate a color ink mixing that would otherwise occur after the execution of the suction-based recovery operation and to print a desired image in a short time by reducing the number of preliminary ejections from the small nozzles compared with that from the large nozzles and by setting the preliminary ejection frequency low.

The lower the ejection frequency of the small nozzles, the more efficiently the generation of stray mist can be suppressed. So, only the ejection frequency of the small nozzles may be set small, with the numbers of preliminary ejections from the large nozzles and from the small nozzles set equal. In this configuration, although the time taken by the preliminary ejection operation becomes longer, the generation of stray mist can be suppressed more efficiently.

Embodiment 3

In Embodiments 1 and 2, description has been made of a print head in which a large-nozzle column is arranged on one side of a liquid chamber and a small-nozzle column is arranged on the other side. In this embodiment, we will describe a print head which has large nozzles and small nozzles arranged alternately and in which the two nozzle columns arranged on both sides of the liquid chamber are made up of large nozzles and small nozzles.

Figure 6:
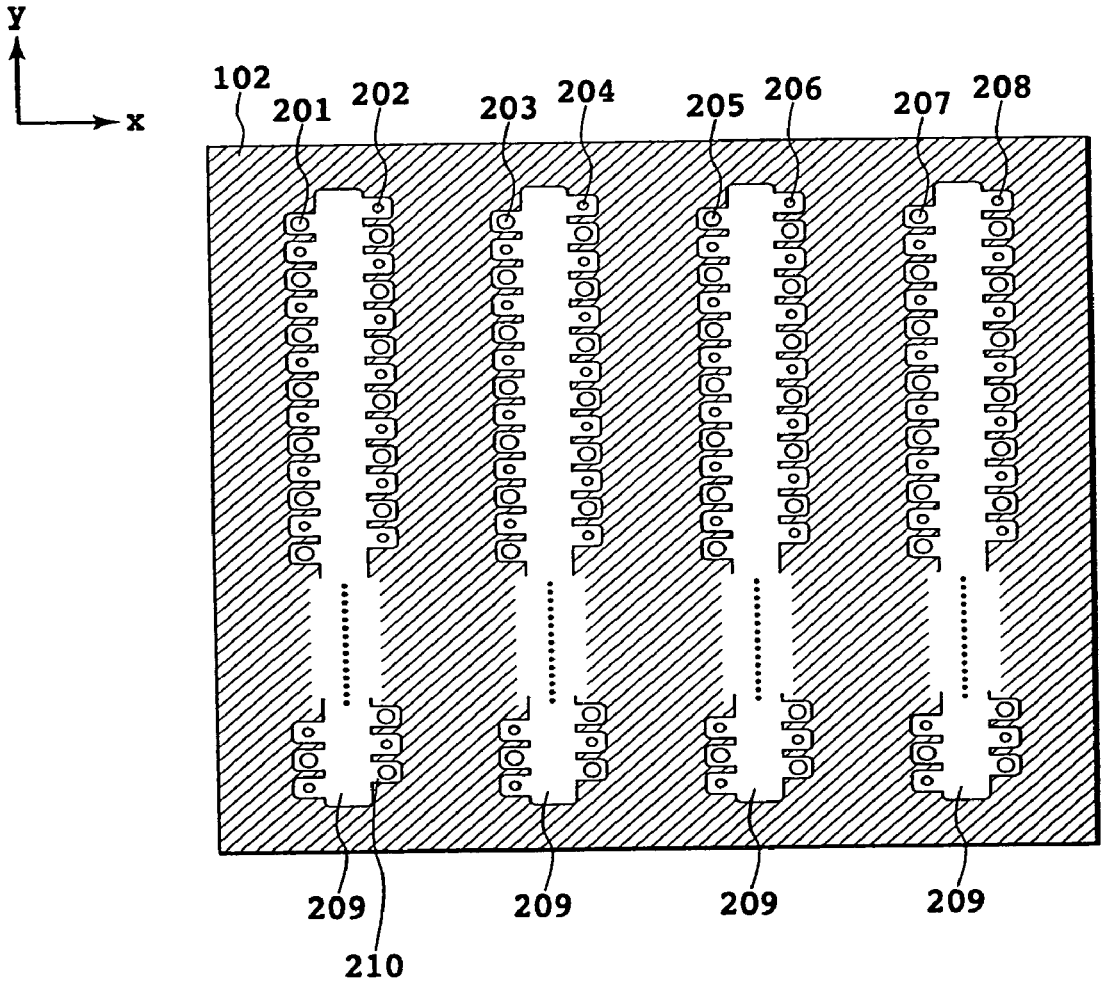
FIG. 6 is a schematic diagram showing another example of the nozzle-formed face of the print head.

FIG. 6 is a schematic diagram showing a nozzle-formed face of the print head used in this embodiment. As described above, each of the nozzle columns has large nozzles 201 and small nozzles 202 alternated.

As with the print head 102 of FIG. 2, the nozzle columns each have 128 ejection openings (128 nozzles) at a nozzle pitch of about 42.4 μm and a print head length of 5.42 mm. The nozzle columns on both sides of the liquid chamber 209 of each color have large nozzles and small nozzles arranged alternately both in x and y directions. The nozzle columns on both sides of the liquid chamber 209 of each color are spaced 0.3 mm from each other, as in the case of FIG. 2. Liquid chambers of different colors are equidistantly spaced at an interval of 1 mm.

In this embodiment, the preliminary ejection operation following the suction-based recovery operation is performed by activating each of the large nozzles 29,000 times at a frequency of 10 kHz, followed by the activation of each of the small nozzles 2,000 times at a frequency of 5 kHz.

In the print head of this embodiment, too, the above preliminary ejection operation can remove the viscous or mixed color ink, be completed in a short time and reduce the volume of stray mist generated.

As described above, in an ink jet printing apparatus with an ink jet print head and a suction device, in which the ink jet print head has at least two kinds of nozzles connected to one and the same liquid chamber and adapted to eject different volumes of liquid and in which a preliminary ejection operation is performed following a suction-based recovery operation, it is possible to eliminate a color ink mixing that would otherwise occur after the execution of the suction-based recovery operation and to print a desired image in a short time by reducing the number of preliminary ejections from the small nozzles compared with that from the large nozzles and by setting the preliminary ejection frequency low.

As described above, since this invention performs the preliminary ejection operation beginning with nozzles with large ejection volumes and at a high ejection frequency, viscous or mixed color ink can be discharged sufficiently from the liquid chamber and liquid paths. Further, since the total number of preliminary ejections can be reduced, the time taken by the preliminary ejection operation can also be reduced. Further, by setting small the ejection frequency of, or the number of preliminary ejections from, nozzles with small ejection volumes, it is possible to minimize the generation of stray mist. Therefore, the staining of print media caused by stray mist adhering to the interior of the printing apparatus can be prevented.

By reducing the number of preliminary ejections from small nozzles and their ejection frequency, the generation of stray mist can further be minimized.

Compared with the conventional method which performs a preliminary ejection operation with equal numbers of preliminary ejections from large nozzles and from small nozzles, this invention can shorten the time taken by the preliminary ejection operation although the total volume of ink discharged remains almost unchanged.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

What is claimed is:

1. An ink jet printing apparatus for forming an image by ejecting ink from a print head onto a print medium, wherein the print head has arrayed in nozzle columns at least a plurality of large nozzles and a plurality of small nozzles, each of the large nozzles ejecting a larger volume of ink per single ejection than each of the small nozzles ejects per single ejection, and the large nozzles and small nozzles eject ink supplied from a common ink chamber, the ink jet printing apparatus comprising:

preliminary ejection means for performing ink ejections, not involved in the formation of an image, from the nozzles of the print head;

suction means for sucking out ink from the print head through the nozzles of the print head; and control means for causing said suction means to suck out ink from the print head and then causing said preliminary ejection means to perform the ink ejections, wherein, in an ink ejection operation by said preliminary ejection means following the suction of ink by said suction means, said control means causes the nozzles of the same size to eject ink simultaneously and controls to set the number of ejections from the large nozzles to be greater than the number of ejections from the small nozzles.

2. An ink jet printing apparatus according to claim 1, wherein said preliminary ejection means executes the ejection operation of the large nozzles before the ejection operation of the small nozzles.

3. An ink jet printing apparatus according to claim 1, wherein said preliminary ejection means sets an ejection frequency of the small nozzles to be lower than an ejection frequency of the large nozzles.

4. An ink jet printing apparatus according to claim 1, wherein the print head is scanned in a direction different from a direction in which the nozzles are arrayed and, during the scan operation, ejects ink onto the print medium, the print medium is fed a predetermined distance in a direction different from the scan direction of the print head in a motion relative to the print head, and the print head scan and the print medium feed are alternately performed repetitively to form an image on an entire surface of the print medium, and wherein the plurality of large nozzles and plurality of small nozzles are arranged alternately in a direction different from the scan direction of the print head to form nozzle columns, and the large nozzles in the nozzle columns are made to execute an ejection operation in advance of the small nozzles.

5. An ink jet printing apparatus according to claim 1, wherein the nozzles each generate a bubble in ink by thermal energy to eject ink as a droplet with a pressure of the inflating bubble.

6. An ink jet printing apparatus for forming an image by ejecting ink from a print head onto a print medium, wherein the print head has arrayed in nozzle columns at least a plurality of large nozzles and a plurality of small nozzles, each of the large nozzles ejecting a larger volume of ink per single ejection than each of the small nozzles ejects per single ejection, and the large nozzles and small nozzles eject ink supplied from a common ink chamber, the ink jet printing apparatus comprising:

preliminary ejection means for performing ink ejections, not involved in the formation of an image, from the nozzles of the print head;

suction means for sucking out ink from the print head through the nozzles of the print head; and control means for causing said suction means to suck out ink from the print head and then causing said preliminary ejection means to perform the ink ejections, wherein, in an ink ejection operation by said preliminary ejection means following the suction of ink by said suction means, said control means causes the nozzles of the same size to eject ink simultaneously and controls to set a frequency at which to eject ink from the small nozzles to be lower than a frequency at which to eject ink from the large nozzles.

7. A preliminary ink ejection method using an ink jet printing apparatus, wherein the ink jet printing apparatus forms an image by ejecting ink from a print head onto a print medium, wherein the print head has arrayed in nozzle columns at least a plurality of large nozzles and a plurality of small nozzles, each of the large nozzles ejecting a larger volume of ink per single ejection than each of the small nozzles ejects per single ejection, and the large nozzles and small nozzles eject ink supplied from a common ink chamber, the preliminary ink ejection method comprising:

a preliminary ejection step of performing ink ejections, not involved in the formation of an image, from the nozzles of the print head;

a suction step of sucking out ink from the print head through the nozzles of the print head; and a control step of causing said suction step to suck out ink from the print head and then causing said preliminary ejection step to perform the ink ejections, wherein, in an ink ejection operation in said preliminary ejection step following the suction of ink in said suction step, said control step causes the nozzles of the same size to eject ink simultaneously and controls to set the number of ejections from the large nozzles to be greater than the number of ejections from the small nozzles.

8. A preliminary ink ejection method according to claim 7, wherein said preliminary ejection step executes the ejection operation of the large nozzles before the ejection operation of the small nozzles.

9. A preliminary ink ejection method according to claim 7, wherein said preliminary ejection step sets an ejection frequency of the small nozzles to be lower than an ejection frequency of the large nozzles.

10. A preliminary ink ejection method according to claim 7, wherein the print head is scanned in a direction different from a direction in which the nozzles are arrayed and, during the scan operation, ejects ink onto the print medium, the print medium is fed a predetermined distance in a direction different from the scan direction of the print head in a motion relative to the print head, and the print head scan and the print medium feed are alternately performed repetitively to form an image on an entire surface of the print medium, and wherein the plurality of large nozzles and plurality of small nozzles are arranged alternately in a direction different from the scan direction of the print head to form nozzle columns, and the large nozzles in the nozzle columns are made to execute an ejection operation in advance of the small nozzles.

11. A preliminary ink ejection method using an ink jet printing apparatus, wherein the ink jet printing apparatus forms an image by ejecting ink from a print head onto a print medium, wherein the print head has arrayed in nozzle columns at least a plurality of large nozzles and a plurality of small nozzles, each of the large nozzles ejecting a larger volume of ink per single ejection than each of the small nozzles ejects per single ejection, and the large nozzles and small nozzles eject ink supplied from a common ink chamber, the preliminary ink ejection method comprising:

a preliminary ejection step of performing ink ejections, not involved in the formation of an image, from the nozzles of the print head;

a suction step of sucking out ink from the print head through the nozzles of the print head; and a control step of causing said suction step to suck out ink from the print head and then causing said preliminary ejection step to perform the ink ejections, wherein, in an ink ejection operation in said preliminary ejection step following the suction of ink in said suction step, said control step causes the nozzles of the same size to eject ink simultaneously and controls to set a frequency at which to eject ink from the small nozzles to be lower than a frequency at which to eject ink from the large nozzles.

* * * * *